US005090152A

United States Patent [19]

Ling

[11] Patent Number: 5,090,152

[45] Date of Patent: Feb. 25, 1992

[54] RODENT BARRIER FOR PIPES

[75] Inventor: Rolf Ling, Gustavsberg, Sweden

[73] Assignee: Aktiebolaget Gustavsberg, Gustavsberg, Sweden

[21] Appl. No.: 585,077

[22] PCT Filed: Apr. 12, 1989

[86] PCT Filed: Apr. 12, 1989

PCT No.: PCT/SE89/00203

§ 371 Date: Oct. 10, 1990

§ 102(e) Date: Oct. 10, 1990

[87] PCT Pub. No.: WO89/09858

PCT Pub. Date: Oct. 19, 1989

[30] Foreign Application Priority Data

Apr. 12, 1988 [SE] Sweden ..... 8801346-1

[51] Int. Cl.[5] ..... A01M 23/00; E03F 7/06

[52] U.S. Cl. ..... 43/64; 43/65; 43/124; 52/101; 137/849; 138/41

[58] Field of Search ..... 43/64, 65, 124; 52/101; 4/286, 255, 257, DIG. 7; 131/844, 846, 847, 849, 859, 439, 517; 285/56, 292, 177, 58; 138/103, 40, 41, 178

[56] References Cited

U.S. PATENT DOCUMENTS

| | | | |
|---|---|---|---|
| 748,201 | 12/1903 | Miller | 43/65 |
| 999,106 | 7/1911 | Hagaman et al. | 43/65 |
| 1,077,104 | 10/1913 | Sowar | 43/65 |
| 2,092,757 | 9/1937 | Groeniger | 137/849 |
| 2,953,248 | 9/1960 | Troland | 137/849 |
| 3,585,646 | 6/1971 | Lopez . | |
| 4,307,476 | 12/1981 | Halstad | 4/255 |

FOREIGN PATENT DOCUMENTS

| | | | |
|---|---|---|---|
| 180986 | 6/1906 | Fed. Rep. of Germany . | |
| 830784 | 8/1938 | France . | |
| 668965 | 3/1952 | United Kingdom | 52/101 |
| 1354691 | 5/1974 | United Kingdom | 137/844 |

*Primary Examiner*—Richard K. Seidel
*Assistant Examiner*—Jeanne M. Elpel
*Attorney, Agent, or Firm*—Toren, McGeady & Associates

[57] ABSTRACT

An arrangement in vertical sewage system pipes for preventing rodents, such as rats, from entering dwellings, living accommodation, office accommodation, and similar building structures. The arrangement includes a frame which is L-shaped in cross-section with an outwardly extending flange sealingly inserted in a joint between two mutually adjacent pipe sections and an axially extending flange to which are attached a plurality of springing wires or rods so as to form a wire cone which tapers in the direction of sewage flow. The springing wires or rods terminate at the apex of the cone in anear touching relationship. The wires or rods are made of stainless steel with a wire gauge of from 0.7 to 2.5 mm or of fiber glass with a wire gauge of from 0.8 to 2.0 mm.

5 Claims, 1 Drawing Sheet

RODENT BARRIER FOR PIPES

BACKGROUND OF THE INVENTION

1. Field of the Invention

The present invention relates to a barrier device for location in sewage systems, domestic waste pipes and the like, with the intention of denying rodents, such as rats, access to domestic buildings and other buildings through such sewage pipes. The barrier device is intended primarily to be placed in vertical sewage or waste pipes.

2. Description of the Prior Art

It is well known that the presence of rats in sewage systems gives rise to serious problems, both from a sanitory aspect and a technical aspect, and that these problems are greater in the large town or city environments, where the nutrient content of the sewage is particularly high. The sanitary problem resides in the access to domestic buildings, multi-unit dwellings, office blocks, storehouses, shops and other buildings available to rats through the sewage systems, primarily through the water closets, of such buildings. The technical problems reside, inter alia, in the damage created by rats gnawing at sewage pipes, resulting in leakages and, at times blockages As is well known, the front teeth of rodents grow at an average rate of 1 mm per month throughout the lifetime of the rodent. Consequently, the rodent is forced to gnaw, in order to maintain its teeth at a manageable length, and will gnaw on the most unlikely objects, even on cast iron pipes.

Laboratory studies and research, and also field research, have shown that rats are able to travel quite freely along sewage pipes, both vertically and horizontally extending pipes. In the case of vertical pipes, so-called downpipes or downcomers, rats are able to climb readily to heights of several stories in the case of multi-story buildings, provided that the internal diameter of the pipes are not greater than 110 mm, which is the pipe diameter most often used with downpipes fitted to multi-unit dwellings.

Detailed studies carried out, inter alia, with the aid of video film techniques which allow certain frequencies to be "frozen" or advanced slowly, have revealed valuable information concerning the climbing techniques of rats. When climbing up a vertical pipe, a rat will press its front and rear legs diametrically against the wall of the pipe to obtain climbing purchase. Large rats will also press their backs against the wall of a pipe, in order to obtain a better purchase. Thus, in order to be able to ascend a pipe, it is necessary for the rat to obtain support against the wall of the pipe. This means that a part of the rat's body will be located in the central region of the pipe as the rat climbs.

Several attempts have been made to prevent the migration of rats through sewage systems. One known example of a device constructed to this end comprises a balanced flap fitted to a sewage pipe, this flap being openable in the direction of sewage flow, but self-closing in the opposite direction. It has been found that rats have overcome this barrier, by mutually cooperating to put the mechanism out of action.

U.S. Pat. No. 3,741,590 teaches an arrangement which is said to prevent rodents climbing up downpipes. The inventive arrangement described in this publication has a conically flared section located in the waste pipe. According to the specification, an incoming pipe section is extended down into the conically flared section, so that no deposits from the sewage will form on the surfaces of said section and therewith deny the rats a foothold on the wall surfaces thereof. In order to prevent rats from using the lower conical part of the flared pipe section as a jumping-off point and therewith reach the incoming pipe section, the latter is provided with a toothed lower edge. However, despite this arrangement, it was found that at least one rat had been successful in climbing further up the downpipe, assisted by other rats which positioned themselves in zig-zag fashion along the flared pipe section.

Although other rodent barriers have been tried, none has been truly successful. These earlier barriers have include the arrangement of a very deep water-seal, so configured as to make it difficult for a rat to climb up the sides of the seal or to swim through the same. However, rats have still been successful in penetrating such barriers, despite their ingenuity. It may also be difficult to position a water-seal, and the provision of such a water-seal may cause problems relating to the flow of water in and the hydraulic function of the sewage system.

A common feature of the aforementioned rodent barriers is that they must be built into sewage pipe or conduit when installing said pipe or conduit and that they can only be installed in existing pipes, etc, with great difficulty. Furthermore, because of their wide diameters, the known rodent barriers are much too large to be accommodated in normal pipe channels preformed in existing buildings.

The object of the present invention is to provide a rodent barrier arrangement which can be mounted in both new sewage pipe installations and in existing, older sewage pipe installations. The arrangement is intended to effectively bar the passage of the common sewer rat and also the larger rat which has recently begun to habit sewage systems in which the sewage has a plentiful supply of nutrient. The characteristic features of the present invention are set forth in the following claims.

SUMMARY OF THE INVENTION

The inventive rodent barrier comprises a cone of spring wires or rods which converge from the wall of a sewage pipe in towards the center thereof. The wire cone extends from a frame structure which seats sealingly against the pipe wall. Since sewage pipes normally have a circular cross-section, the frame will have a corresponding shape. In order to enable the frame to be mounted firmly in position in a suitably located pipe joint, the frame will preferably have an L-shaped cross-section, wherewith one flange or lip of the L-form is fitted either into a sleeve and fixed positionally by the pointed end of an adjacent pipe or is mounted between two pipe ends embraced by a sweep coupling. The wires are attached to the other flange or lip of the L-form. The frame must be made of a material which is resistant to corrosion. Brass is one suitable material in this respect, although a still better material is a polymeric or thermoplastic material. In the case of this latter material, the frame can be injection moulded and the wires which form the aforesaid wire cone can be placed in the mould prior to injecting the plastic material thereinto in the manufacture of the frame. This will ensure that the wires are anchored firmly in the frame. The wires themselves may be made of stainless steel or fiber glass. By configuring the wire outlets at a desired angle in relation to the center axis of the arrangement, it is possible to establish the angle which to some extent is dependent on the dimensions of the frame. In the case of ring shaped frames having diameters of up to 160 mm, an angle of the wire cone of 30° has been found suitable while in the case of frames which are 100 mm in diameter, a suitable angle is 15°.

In the case of large diameter frames, a suitable wire gauge is 2.5 mm when stainless steel wire is used, falling to a gauge of 0.7 mm in the case of frames of the smaller diameter. When the wires are made of glass fiber, suitable wire gauges are 2.0–0.8 mm. In order to prevent rats from forcing their way through the wire interspacings, the wires shall have a maximum spacing of 12 mm. A wire density or interspacing of less than 7 mm will unecessarily command an undue number of wires. Because it is not possible in the case of vertical pipes for a rat to obtain a purchase against a pipe wall while, at the same time, attempting to force apart the wires at the top of the cone, the diametrical spacing here may be 20 mm.

Practical trials have shown that the inventive barrier will not influence the function of a sewage or waste pipe in any negative fashion. For instance, solids have not been found to hang onto or be caught by the barrier wires, but that any solids that are trapped in the conical barrier, which tapers in the direction of fluid flow, are freed when the wires are sprung apart by the force of the flow and continue to flow along the pipe. This has also been found true in the case of pipes having a diameter of 110 mm and heavily loaded with such waste as used sanitary napkins. This means that the inventive rodent barrier will not create problems of a flow technical nature and that normal oscillations between pressures above and below ambient pressure will not be affected. Thus, in the case of the inventive barrier, there is no need to provide a pressure equalizing by-pass pipe as in the case of water-seal barriers.

BRIEF DESCRIPTION OF THE DRAWING

A preferred embodiment of the invention will now be described in more detail with reference to the accompanying drawing, in which.

DESCRIPTION OF THE PREFERRED EMBODIMENT

Figures 1, 2:
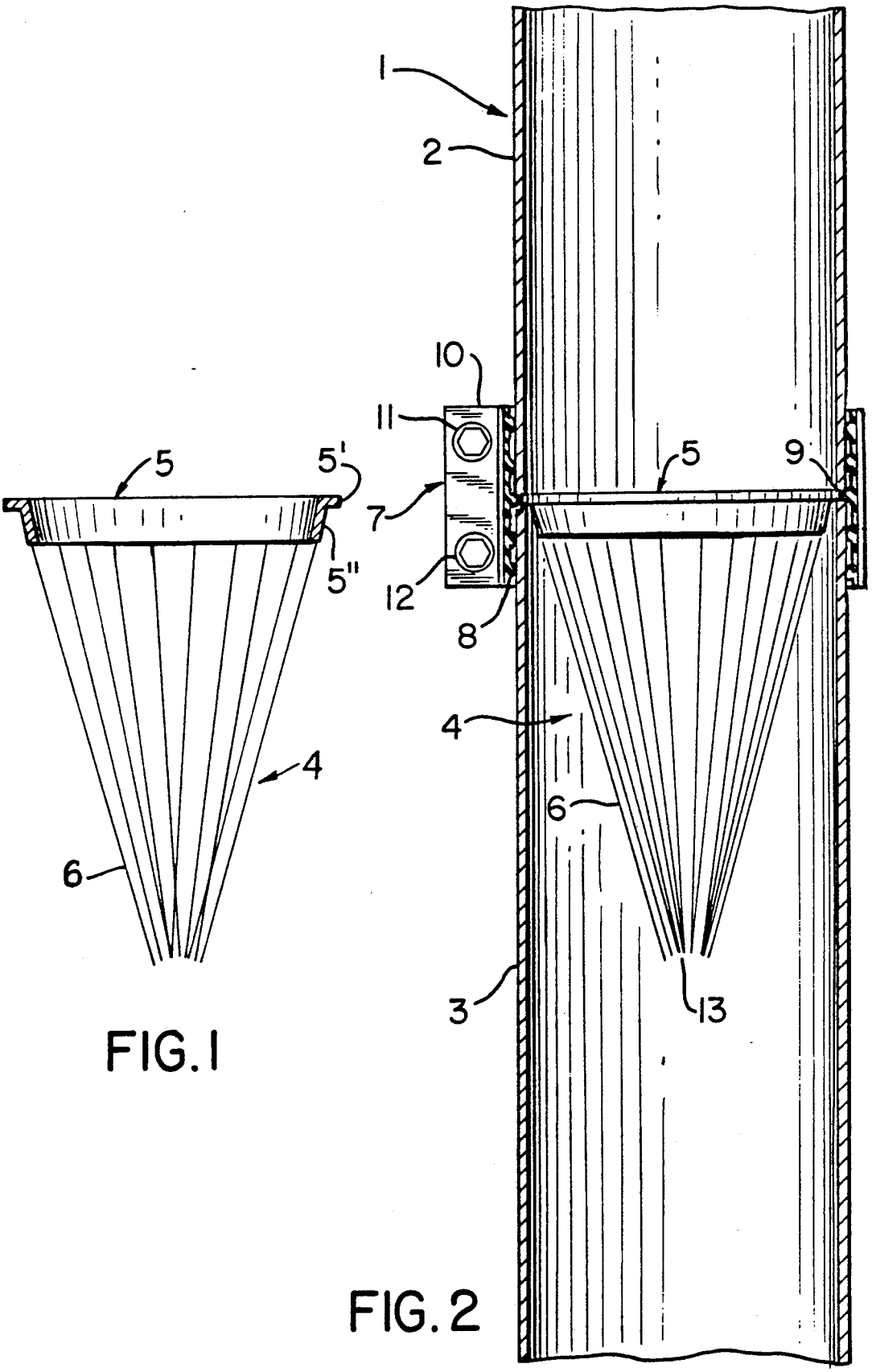
FIG. 1 is a vertical sectional view of the inventive rodent barrier.
FIG. 2 is a vertical sectional view of a sewage pipe or conduit and shows a rodent barrier mounted in a pipe join.

The drawing shows a rodent trap 4 mounted in the join between an upper section 2 and a lower section 3 of a sewage pipe or conduit 1. The barrier 4 comprises a polymer ring 5, which is L-shaped in cross-section, and an arrangement of wires or rods, hereinafter referred to as a wire cone 6.

The polymer ring 5 has a horizontally extending lip or flange 5' which extends into the join between the two pipe sections 2 and 3. In order to guarantee a seal at the region of the join, the mutually opposing ends of the pipe sections 2 and 3 are embraced externally by a bridging or bridle coupling 7, for instance of the kind described in SE-B-338019. The coupling 7 comprises an inner, rubber sleeve 8 having a tongue 9 which extends inwardly from the inner surface of the sleeve and enters the space between said mutually opposing pipe ends, and an embracing metal fairing or cover 10. The fairing 10 can be tightened around the rubber sleeve with the aid of two screws 11,12, so as to ensure that the join between the two pipe ends is completely sealed. The resiliency of the flange 5' on the polymer ring 5 will also assist in providing an effective seal.

The wire cone 6 extends from the cylindrical or conical part 5'' of the polymer ring 5 such as to taper with the direction of sewage flow, said cylindrical or conical flange part 5'' extending at an angle to the plane of the flange 5'. The wires or rods which form the cone 6 are attached in uniform spaced relationship to the part flange 5'', which extends in the flow direction, said wire spacing being from 7 to 12 mm. The length and gauge of the respective wires or rods used will vary in accordance with the diameter of the pipes for which the barrier is intended, the length because the top angle of the cone is made less acute in the case of pipes of large diameter, and the wire gauge because the wires or rods fitted to pipes of large diameter need to withstand the gnawing attack of larger rodents. It must not be possible for rodents to force the wires or rods apart and therewith manufacture an entrance through the barrier 4.

In the case of pipe diameters of 110 mm, it has been found that when the wires or rods are made of stainless steel a suitable length is 250 mm and a suitable gauge 1.2 mm. The wires converge in the direction of the flow and describe the surface of a fictive frustated cone having a top angle of 18°. Although the opening 13 defined by the ends of the wires or rods at the apex of the cone is in itself large enough to allow a rat to pass through, because rats climb with their bodies positioned diametrically across the pipe bore they will be unable to pass through the opening nevertheless. The area of the opening 13 is sufficient to allow the through passage of certain waste, but in the case of large waste agglomerates the wires or rods are forced apart so that the agglomerates will pass through, whereafter said wires or rods spring back into their rodent barrier position.

The inventive barrier can be installed readily in the coupling sockets of pipes that are under installation. The inventive rodent barrier 4 can also be mounted readily in existing pipe installations, by cutting through the existing downpipe at two locations, preferably at some meters distance from the nearest horizontal pipe, and mounting the barrier in a collarless pipe and then joining said pipe to the severed downpipe with the aid of the aforesaid bridle coupling.

I claim:

1. An arrangement in vertical sewage system pipes for preventing rodents from entering building structures through said sewage systems, the arrangement comprising a frame (5) which is L-shaped in cross-section, the frame (5) having an outwardly extending flange (5') sealingly inserted in a joint between two mutually adjacent pipe sections (2, 3), the frame (5) further comprising an axially extending flange (5'') having therefrom extending a plurality of springing wires or rods, forming a wire cone (6) which tapers in the direction of sewage flow, the springing wires or rods in said cone (6) terminating at the apex of said cone in near touching relationship, and the wires or rods being made of stainless steel and having a wire gauge of from 0.7 to 2.5 mm or being made of fiber glass having a wire gauge of from 0.8 to 2.0 mm.

2. An arrangement according to claim 1, wherein the frame (5) is circular.

3. An arrangement according to any one of claims 1 or 2, wherein the frame (5) is made of a non-corrodible material.

4. An arrangement according to one of claims 1 or 2, wherein the wires or rods of the wire cone (6) extend at an angle of between 15° and 30° relative to a center axis of the arrangement.

5. An arrangement according to any one of claims 1 or 2, wherein the wires or rods forming said cone are attached to the frame at an interspacing of between 7 and 12 mm.

* * * * *